US007151520B2

(12) United States Patent
Maki

(10) Patent No.: US 7,151,520 B2
(45) Date of Patent: Dec. 19, 2006

(54) LIQUID CRYSTAL DRIVER CIRCUITS

(75) Inventor: Katsuhiko Maki, Chino (JP)

(73) Assignee: Seiko Epson Corporation, Tokyo (JP)

( * ) Notice: Subject to any disclaimer, the term of this patent is extended or adjusted under 35 U.S.C. 154(b) by 312 days.

(21) Appl. No.: 10/342,109

(22) Filed: Jan. 13, 2003

(65) Prior Publication Data

US 2003/0146909 A1 Aug. 7, 2003

(30) Foreign Application Priority Data

Jan. 17, 2002 (JP) ..... 2002-008374

(51) Int. Cl.
*G09G 3/36* (2006.01)

(52) U.S. Cl. ..... 345/99; 345/98; 345/10; 345/204

(58) Field of Classification Search ..... 345/87–88, 345/98–99, 100, 204
See application file for complete search history.

(56) References Cited

U.S. PATENT DOCUMENTS 6,154,065 A * 11/2000 Komatsu ..... 327/56
6,498,534 B1 * 12/2002 Kim et al. ..... 330/136
6,680,733 B1 * 1/2004 Woo et al. ..... 345/212
6,781,532 B1 * 8/2004 Wei ..... 341/122
6,806,854 B1 * 10/2004 Cairns et al. ..... 345/87
6,897,800 B1 * 5/2005 Chia ..... 341/155
2004/0080522 A1 * 4/2004 Nitta et al. ..... 345/690

FOREIGN PATENT DOCUMENTS

JP 05-204334 8/1993
JP 11-175042 7/1999

* cited by examiner

*Primary Examiner*—Richard Hjerpe
*Assistant Examiner*—Leonid Shapiro
(74) *Attorney, Agent, or Firm*—Hogan & Hartson LLP

(57) ABSTRACT

A liquid crystal driver circuit is equipped with a memory circuit that temporarily stores inputted image data, a first selector circuit that successively selects image data of multiple channels that are read from the memory circuit and outputs the same in a time-divided manner, a digital/analog conversion circuit that converts the image data output in a time-divided manner from the first selector circuit into analog image signals, an amplification circuit that amplifies the analog image signals obtained by the digital/analog conversion circuit, and a second selector circuit that successively selects a plurality of output terminals and distributes the analog image signals amplified by the amplification circuit in a time-divided manner to the plurality of output terminals.

12 Claims, 8 Drawing Sheets

(a) Frame Inversion (b) Row Inversion (Line Inversion)

(c) Column Inversion (d) Dot Inversion

LIQUID CRYSTAL DRIVER CIRCUITS

BACKGROUND OF THE INVENTION

The present invention generally relates to a liquid crystal driver circuit for driving a Liquid Crystal Display (LCD) apparatus, and more particularly, to a liquid crystal driver circuit that drives Thin Film Transistors (TFTs).

In a liquid crystal driver circuit that drives sources electrodes of TFTs (source driver) used in an LCD, digital image data read from a Random Access Memory (RAM) is converted into analog image signals by a Digital-to-Analog Converter (DACs), and the analog image signals are amplified by an operational amplifier and supplied to source lines of TFTs.

FIG. 7 shows a part of a conventional liquid crystal driver circuit used in a liquid crystal display apparatus. FIG. 7 shows a liquid crystal driver circuit including a RAM 10 that temporarily stores red color (R), green color (G) and blue color (B) image data, DACs 21–23 that convert RGB image data for each pixel read out from the RAM 10 into analog image signals, respectively, and operational amplifiers 131–133 that amplify the analog image signals output from the DACs 21–23, respectively.

The analog image signals amplified by the respective operational amplifiers are supplied to a source line 101 of TFTs 111, 121, . . . , a source line 102 of TFTs 112, 122, . . . and a source line 103 of TFTs 113, 123, . . . , respectively, which drive multiple dots of an LCD panel included in the liquid crystal display apparatus. Capacitors C11, C21, . . . , C12, C22, . . . , and C13, C23, . . . , indicate capacities of the respective dots of the LCD panel.

In this manner, the conventional liquid crystal driver circuit includes Digital-to-Analog Converters, and operational amplifiers in the same number as the number of source lines of the liquid crystal display apparatus. Accordingly, power consumption can increase by rest current of the operational amplifiers and an increased chip area.

Japanese laid-open patent application HEI 5-204334 describes a liquid crystal driver circuit with a reduced number of operational amplifiers. This liquid crystal driver circuit is equipped with data retaining devices that retain image data. The liquid crystal driver circuit is also equipped with an amplifier device that switches and amplifies in a time-divided manner data that is retained at the data retaining devices corresponding to multiple signal lines, and outputs the same in a time-divided manner to output lines corresponding to the respective signal lines. However, although this liquid crystal driver circuit can reduced the number of operational amplifiers, the number of DACs cannot be reduced.

Japanese laid-open patent application HEI 11-175042 describes a liquid crystal driver circuit with a reduced number of DACs. In this liquid crystal driver circuit, before converting digital signals into analog signals via decoders, operations of selecting a specified channel by a multiplexer and decoding data of the selected specified channel are repeated. The data are then demultiplexed. However, with this liquid crystal driver circuit, although the number of DACs can be reduced, the number of output buffer sections that correspond to operational amplifiers cannot be reduced. Moreover, in addition to the multiplexer and demultiplexer, a second latch section for retaining image data of multiple channels is required in a succeeding stage of the demultiplexer.

Accordingly, there is a need for liquid crystal driver circuits that can reduce the power consumption and chip areas by reducing the number of DACs and operational amplifiers without adding an extra latch circuit.

SUMMARY OF THE PREFERRED EMBODIMENTS

Liquid crystal driver circuits in accordance with embodiments of the present invention can include a memory circuit, a first selector circuit, a digital-to-analog conversion circuit, and a second selector circuit. The memory circuit temporarily stores inputted image data. The first selector circuit successively selects image data of multiple channels that are read from the memory circuit and outputs the same in a time-divided manner. The digital/analog conversion circuit that converts the image data output in a time-divided manner from the first selector circuit into analog image signals. The amplification circuit amplifies the analog image signals obtained by the digital/analog conversion circuit. The second selector circuit successively selects a plurality of output terminals and distributes the analog image signals amplified by the amplification circuit in a time-divided manner to the plurality of output terminals.

In some embodiments, the digital/analog conversion circuit may be a resistance circuit network type digital/analog converter that converts the image data output in a time-divided manner from the first selector circuit into analog image signals with $\gamma$ correction being rendered.

In other embodiments, the second selector circuit may distribute the analog image signals amplified by the amplification circuit in a time-divided manner to a plurality of TFTs of a liquid crystal display apparatus through the plurality of output terminals.

In still other embodiments, the amplification circuit may include a P type amplifier, an N type amplifier, and a third selector circuit. The P type amplifier can include a P-channel transistor that flows current from a first power supply potential to an output point according to analog image signals obtained by the digital/analog conversion circuit; an N type amplifier including an N-channel transistor that flows current from an output point to a second power supply potential according to analog image signals obtained by the digital/analog conversion circuit; and a third selector circuit that alternately switches between the analog image signals output from the output point of the P type amplifier and the analog image signals output from the output point of the N type amplifier.

In other embodiments, a control circuit may further be provided to control the first through third selector circuits such that selection timings of the first through third selector circuits are synchronized with one another. Also, the second and third selector circuits may alternately select the analog image signals output from the output point of the P type amplifier and the analog image signals output from the output point of the N type amplifier, and distribute the same in a time-divided manner to a plurality of TFTs of a LCD apparatus. Here, dots having the TFTs to which the analog image signals output from the output point of the P type amplifier are distributed and dots having the TFTs to which the analog image signals output from the output point of the N type amplifier are distributed may preferably be arranged mutually adjacent to one another in two directions perpendicular to each other.

In such liquid crystal driver circuits, the first and second switching circuits are used to switch image signals in a preceding stage of the digital/analog conversion circuit and in a succeeding stage of the amplification circuit, respectively. Therefore, the number of DACs and operational amplifiers can be reduced without adding an extra latch circuit. Accordingly, the power consumption of the liquid crystal driver circuit and its chip area can be reduced.

BRIEF DESCRIPTION OF DRAWINGS

The following discussion may be best understood with reference to the various views of the drawings, described in summary below, which form a part of this disclosure.

DETAILED DESCRIPTION OF THE PREFERRED EMBODIMENTS

Figure 1:
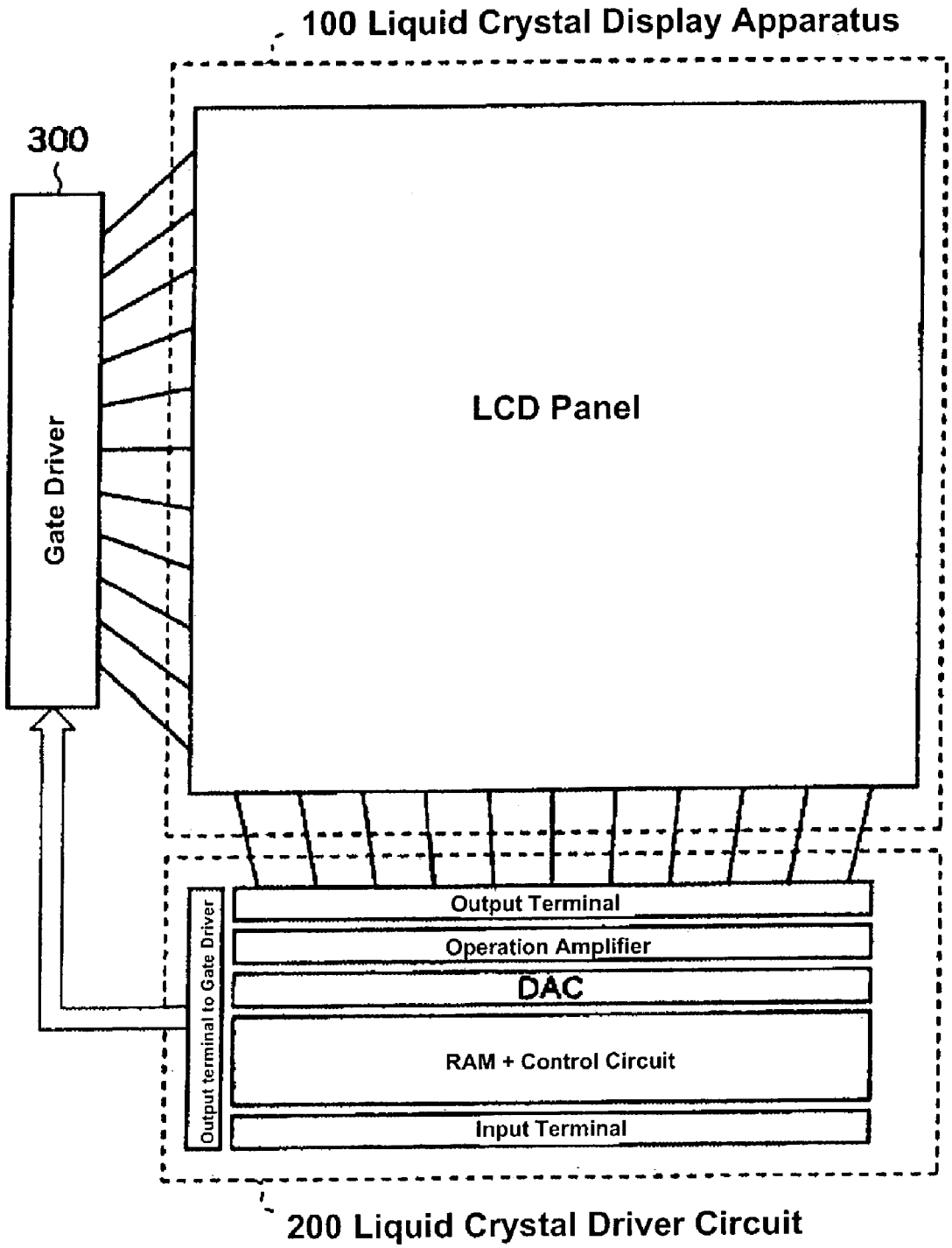
FIG. 1 shows a connection between a liquid crystal driver circuit in accordance with embodiments of the present invention and a liquid crystal display apparatus.

The present invention now will be described more fully with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the size of functional units are exaggerated for clarity. Like numbers refer to like elements throughout.

It will be understood that when an element such as a circuit, portion of a circuit, logic unit or line is referred to as being "connected to" another element, it can be directly connected to the other element or intervening elements may also be present. In contrast, when an element is referred to as being "directly connected to" another element, there are no intervening elements present. When an element such as a circuit, portion of a circuit, logic unit or line is referred to as being "adjacent" another element, it can be near the other element but not necessarily independent of the other element. When an element such as a circuit, portion of a circuit, logic unit or line is referred to as being "between" two things, it can be either partly of completely between those two things, but is not necessarily completely and continuously between those two things. The term "adapted to" should be construed to mean "capable of".

FIG. 1 shows a connection relation between a liquid crystal driver circuit and a liquid crystal display apparatus. The liquid crystal display apparatus 100 includes an LCD panel having a plurality of TFTs corresponding to a plurality of dots that are disposed in a two-dimensional matrix. To drive the liquid crystal display apparatus 100, a liquid crystal driver circuit (source driver) 200 is connected to a plurality of source lines of the TFTs, and a gate driver 300 is connected to a plurality of gate lines of the TFTs.

The liquid crystal driver circuit 200 includes, as main components to be described below, a RAM, a control circuit, DAC and an operational amplifier, as well as an input terminal, an output terminal and an output terminal connecting to the gate driver.

Figure 2:
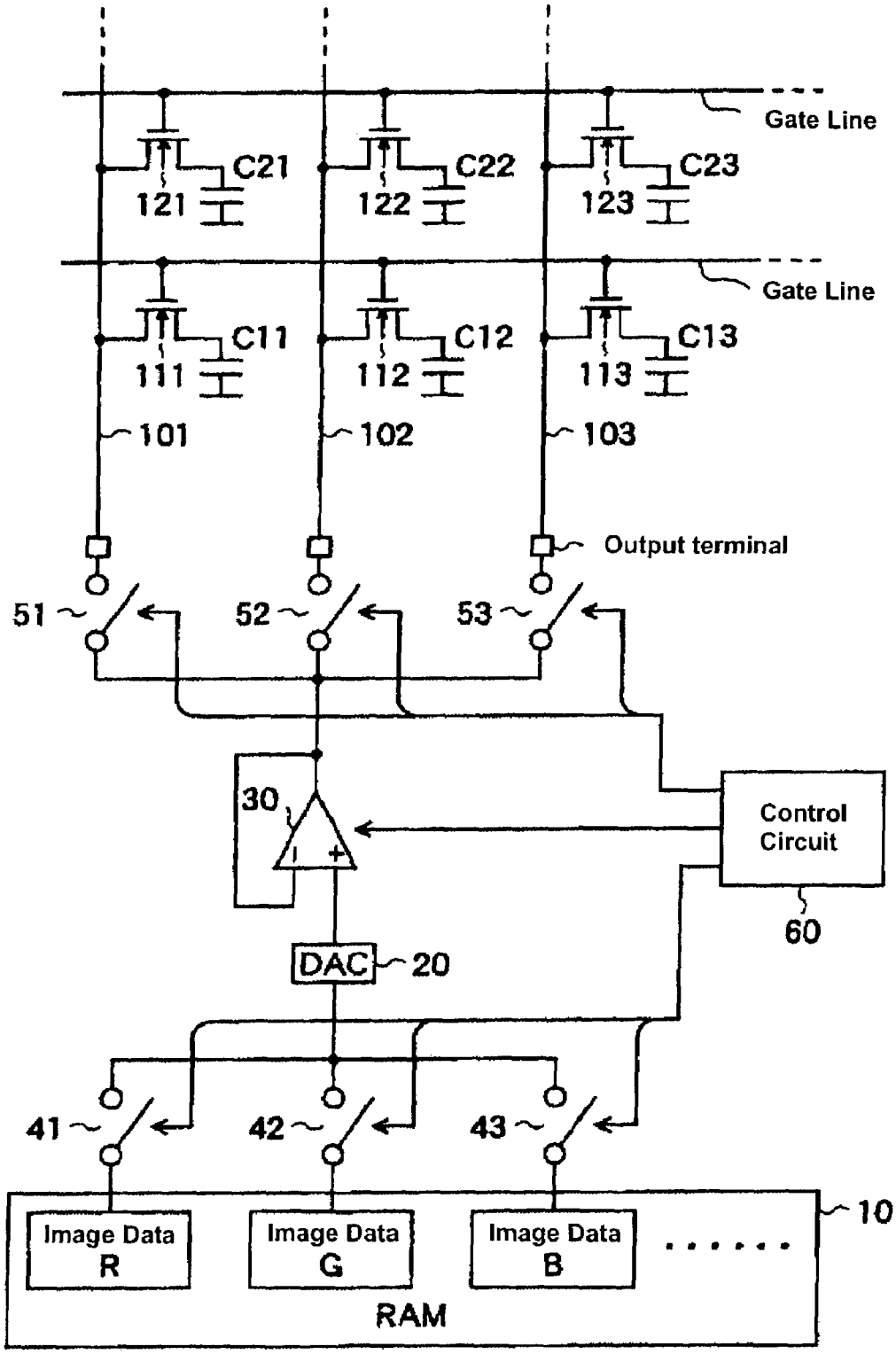
FIG. 2 shows a part of the liquid crystal driver circuit in accordance with embodiments of the present invention and a part of the liquid crystal display apparatus.

FIG. 2 shows a part of the liquid crystal driver circuit and a part of the liquid crystal display apparatus. The liquid crystal driver circuit includes a RAM 10 that temporarily stores inputted image data, switches 41–43 (collectively referred to as a "first selector circuit") that successively select image data of multiple channels that are read from the RAM 10 in a time-divided manner and output the same in a time-divided manner, a DAC 20 that converts the image data output in a time-divided manner from the switches 41–43 into analog image signals, an operational amplifier 30 that amplifies the analog image signals obtained by the DAC 20, switches 51–53 (collectively referred to as a "second selector circuit") that successively select a plurality of output terminals and distributes the analog image signals amplified by the amplification circuit in a time-divided manner to the plurality of output terminals, and a control circuit 60 that controls the various components.

Under the control of the control circuit 60, the switches 41–43 successively select image data of three channels R, G and B that are read from the RAM 10. In each one horizontal synchronizing period (1H), R, G and B image data are successively selected in a time-divided manner.

As noted above, the image data selected by the switches 41–43 are converted by the DAC 20 into analog image signals. The DAC 20 may be implemented, for example, via a resistance circuit network type DAC that uses multiple resistances. Resistance values of these resistances are set to have γ correction property such that the inputted image data can be converted to analog image signals with their γ correction being rendered.

The analog image signals output from the DAC 20 are inputted in and amplified by the operational amplifier 30. The analog image signals output from the operational amplifier 30 are successively output by the switches 51–53 through the plurality of output terminals to source lines 101–103 of the liquid crystal display apparatus. Switching timings of the switches 51–53 are controlled by the control circuit 60 to synchronize with switching timings of the switches 41–43.

In the liquid crystal display apparatus, a plurality of TFTs drive corresponding dots in the LCD panel. The source line 101 is connected to sources of TFTs 111, 121, . . . , the source line 102 is connected to sources of TFTs 112, 122, . . . and the source line 103 is connected to sources of TFTs 113, 123, . . . Among the plurality of transistors that are connected to each of the source lines, transistors with their gate lines at a high level are activated, such that analog image signals are supplied to dots connected to these transistors. It is noted that capacitors C11, C21, . . . , C12, C22, . . . , and C13, C23, . . . , determine capacities of the respective dots of the LCD panel.

Figure 3:
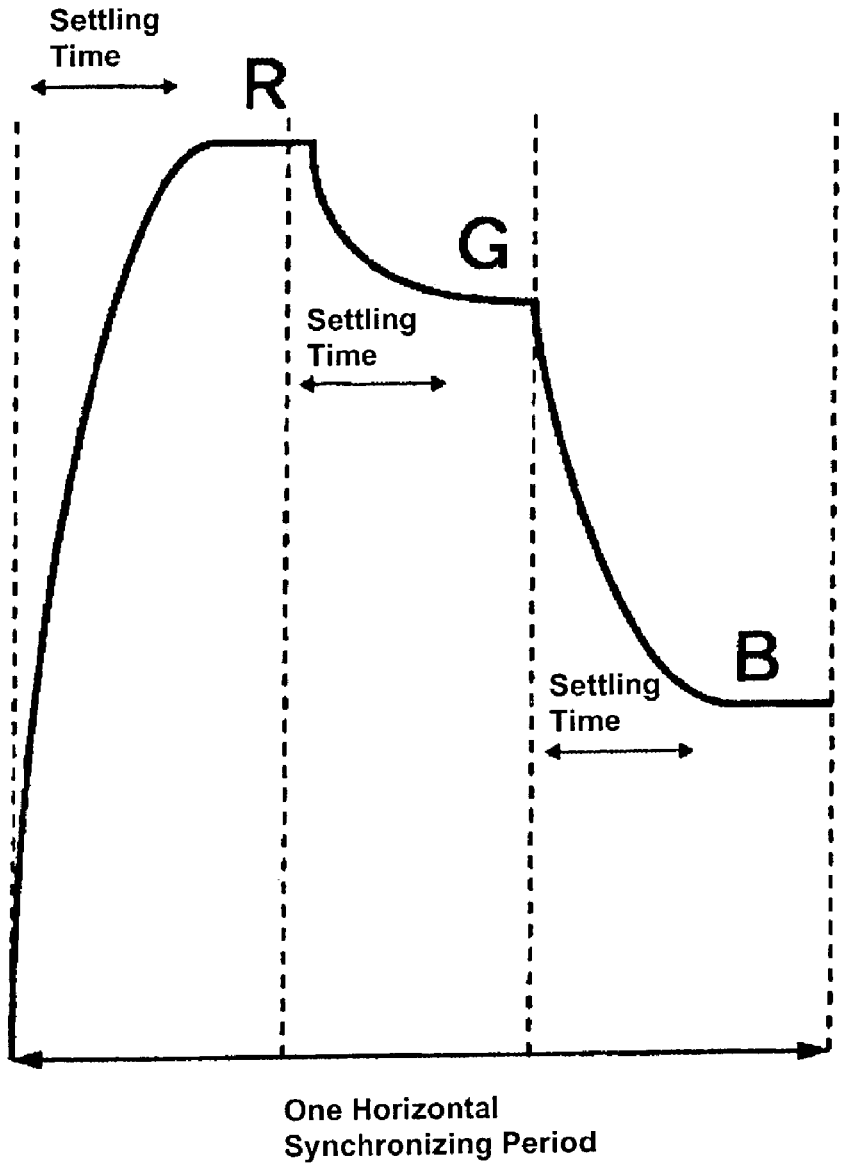
FIG. 3 is a graph illustrating changes in the output voltage of an operational amplifier shown in FIG. 2 with respect to time.

FIG. 3 illustrates an example of changes in the output voltage of the operational amplifier 30 with respect to time (horizontal axis). Within each horizontal synchronizing period, the operational amplifier 30 successively outputs (vertical axis) analog image signals of three channels, R, G and B in a time-divided manner. As indicated in FIG. 3, a certain settling time is required for the output voltage of the operational amplifier 30 to reach its respective target value.

For each dot of the LCD panel, after the output voltage of the operational amplifier 30 reaches its target value, that voltage is retained by the capacitor corresponding to that particular dot. Accordingly, even after the switch is opened, each of the dots maintains the level of an analog image signal supplied from the operational amplifier 30 until it is replaced with a next analog image signal.

By conducting the switching operations in the liquid crystal driver circuit in this manner, one set of a DAC and an operational amplifier is required for the three channels for R, G and B. Also, the channel's switching cycle is about 20 μ seconds (which can be, for example, 1H=60 μ seconds–70 μ seconds in the case of LCD panels used in mobile telephones). Therefore a high frequency circuit is not required for switching channels. Furthermore, the gate lines in the liquid crystal display apparatus may be provided as in the conventional apparatus, and only a source driver may require modification. Thus the invention can be readily realized. As described above, one selection circuit is used to switch three channels. However, the number of channels to be switched by one selection circuit may be two or four or more.

Next, a liquid crystal driver circuit in accordance with other embodiments of the present invention will be described. In these embodiments, an amplification circuit shown in FIG. 4 is used instead of the operational amplifier 30 shown in FIG. 2.

Figure 4:
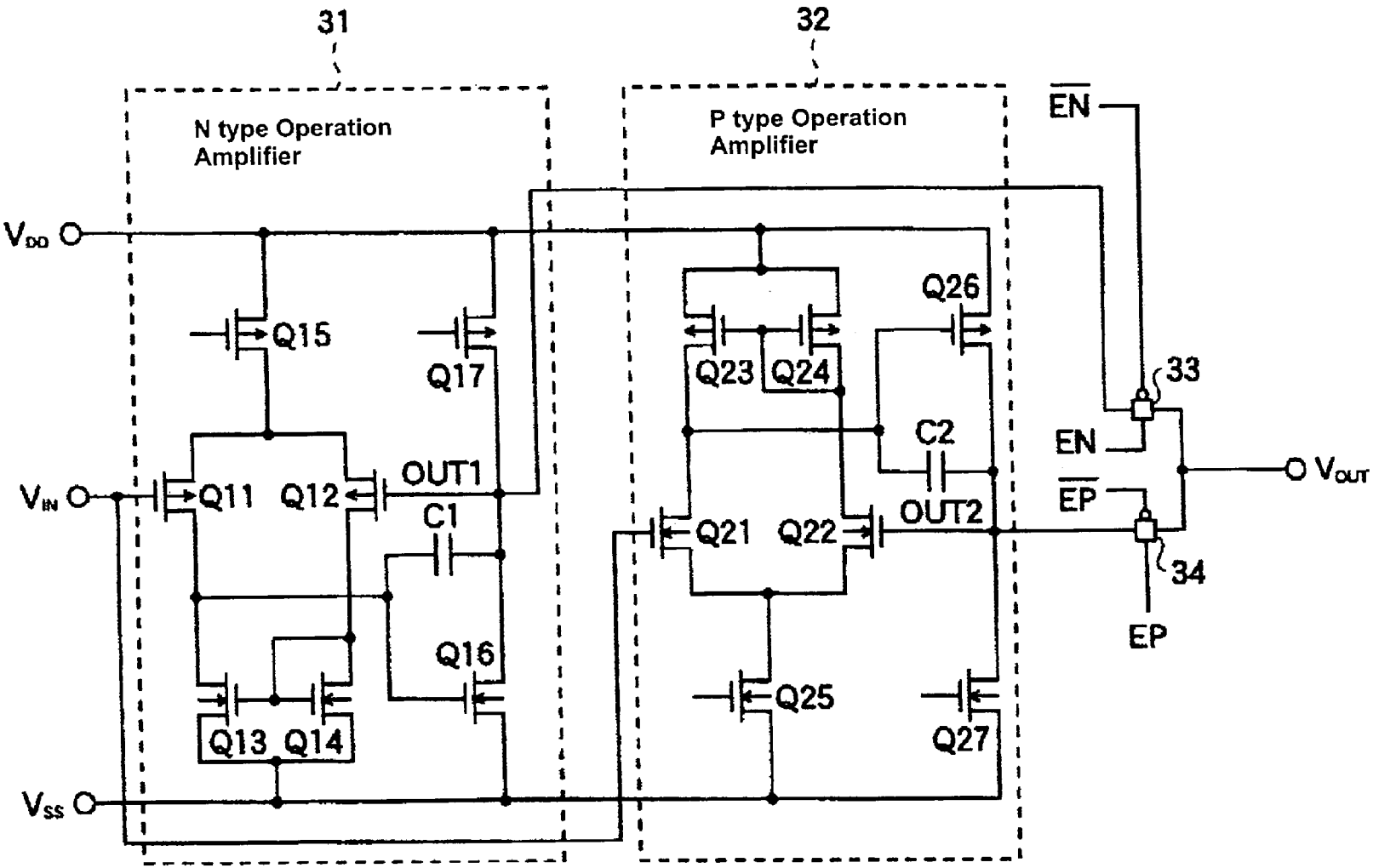
FIG. 4 shows a circuit diagram of an amplification circuit that is used in a liquid crystal driver circuit in accordance with other embodiments of the present invention.

The amplification circuit shown in FIG. 4 includes an N type operational amplifier 31 including transistors Q11–Q17 and a capacitor C1, a P type operational amplifier 32 including transistors Q21–Q27 and a capacitor C2, and transmission gates 33 and 34 (third selection circuit) that alternately switch output signals from the N type operational amplifier 31 and output signals from the P type operational amplifier 32.

The N type operational amplifier 31 includes a differential pair of P-channel transistors Q11 and Q12 that amplify an input signal $V_{IN}$, and an N-channel transistor Q16 that flows current from an output point OUT 1 toward a power supply potential $V_{SS}$ according to the amplified input signal.

On the other hand, the P type operational amplifier 32 includes a differential pair of N-channel transistors Q21 and Q22 that amplify an input signal $V_{IN}$, and a P-channel transistor Q26 that flows current from a power supply potential $V_{DD}$ toward an output point OUT 2 according to the amplified input signal.

Figure 8:
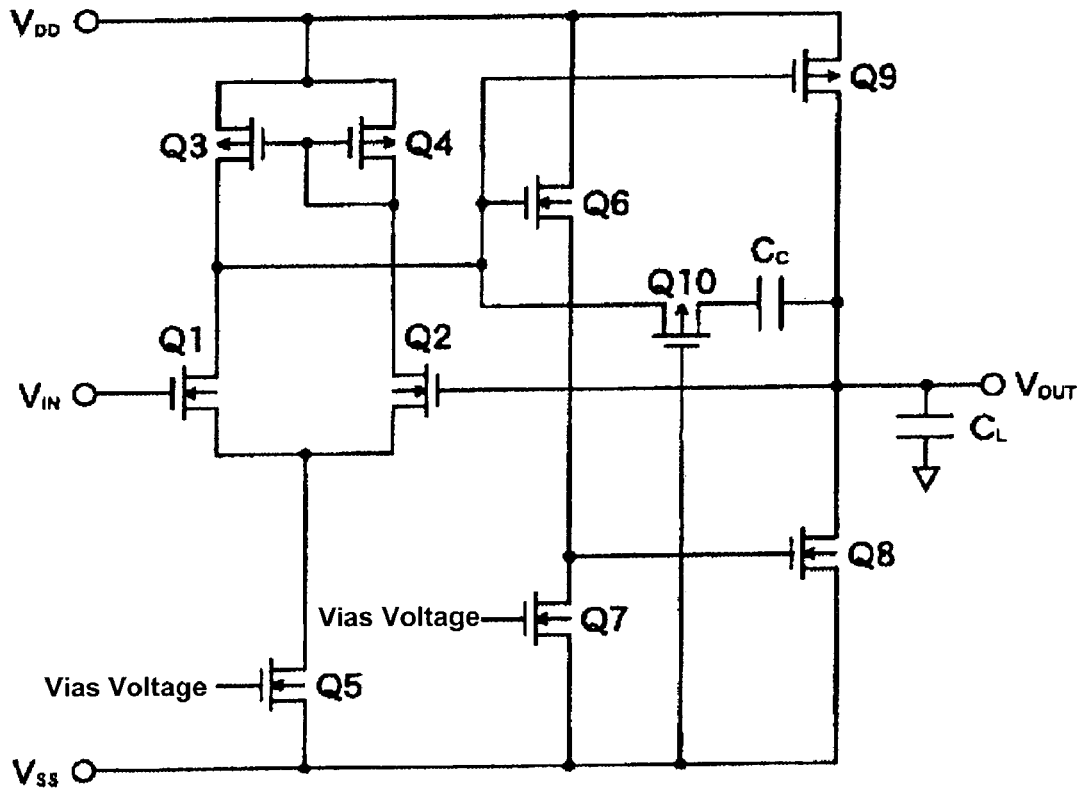
Fig. 8 (Prior Art)
FIG. 8 shows a circuit diagram of an operational amplifier that is used in a conventional liquid crystal driver circuit shown in FIG. 7.

The N type operational amplifier 31 and the P type operational amplifier 32 have the advantage of smaller power consumption compared to an AB class operational amplifier such as the one shown in FIG. 8. However, there are drawbacks. For instance, the N type operational amplifier 31 has a lower capability of raising the output signal such that its rising edge becomes blunt, and the P type operational amplifier 32 has a lower capability of raising the output signal such that its rising edge becomes blunt. Accordingly, the N type operational amplifier 31 and the P type operational amplifier 32 are alternately switched and used.

The transmission gate 33 allows output signals from the output point OUT1 of the N type operational amplifier 31 to pass when an enable signal EN is at a high level and an inverted enable signal EN bar is at a low level. On the other hand, the transmission gate 34 allows output signals from the output point OUT2 of the P type operational amplifier 32 to pass when an enable signal EP is at a high level and an inverted enable signal EP bar is at a low level. These output signals are output as output voltages $V_{OUT}$.

Next, switching of the N type operational amplifier 31 and the P type operational amplifier 21 will be described in connection with the liquid crystal display apparatus.

Figure 5:
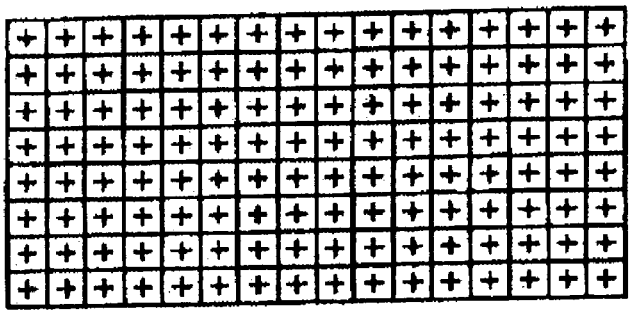
FIGS. 5(*a*)–5(*d*) are drawings for describing methods of inverting applied potentials in a liquid crystal display apparatus.
Figure 5:
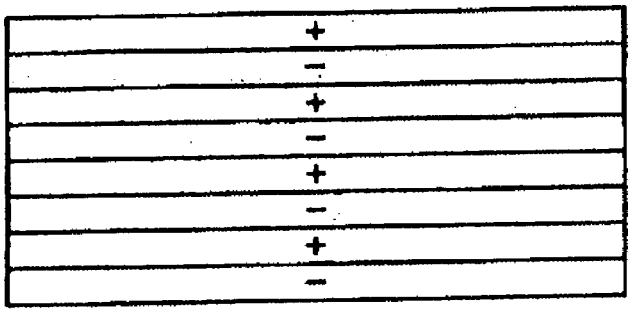
Figure 5:
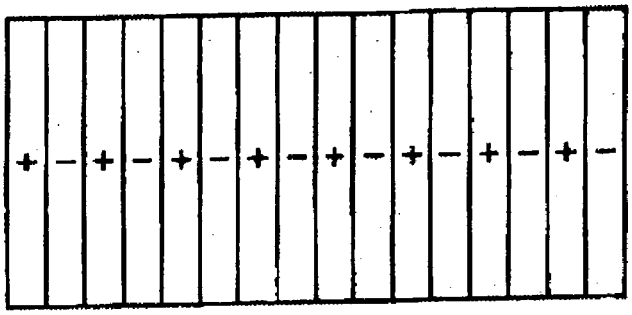
Figure 5:
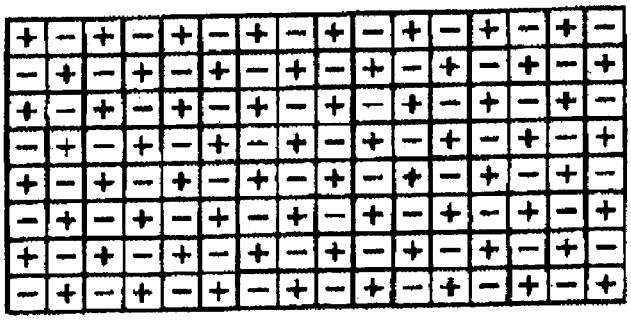

FIGS. 5(*a*)–5(*d*) are drawings to describe inversions of applied potentials in the liquid crystal display apparatus. Electrodes of the LCD panel need to be AC driven, such that potentials to be applied to the electrodes on one side are inverted for driving between a first potential (indicated with "+") and a second potential (indicated with "–"). It is noted that the brightness of the screen on the LCD panel is not determined by a potential applied to the electrodes on one side, but determined by a potential difference of applied potentials between the electrodes on both sides. Methods of inverting applied potentials in an ordinary liquid crystal display apparatus will now be described with reference to FIGS. 5(*a*)–5(*d*).

In a frame inversion indicated in FIG. 5(*a*), potentials applied to all of the dots are inverted at each frame. In a line inversion indicated in FIG. 5(*b*), application potentials are inverted at each line. In a column inversion indicated in FIG. 5(*c*), application potentials are inverted at each column. In a dot inversion indicated in FIG. 5(*d*), application potentials are inverted at each dot. Among these methods, the line inversion, which is relatively, readily realized, is used in small-sized liquid crystal display apparatuses such as portable telephone or the like, and the dot inversion, which does not cause noticeable flickers, is used in large-sized liquid crystal display apparatuses.

Figure 6:
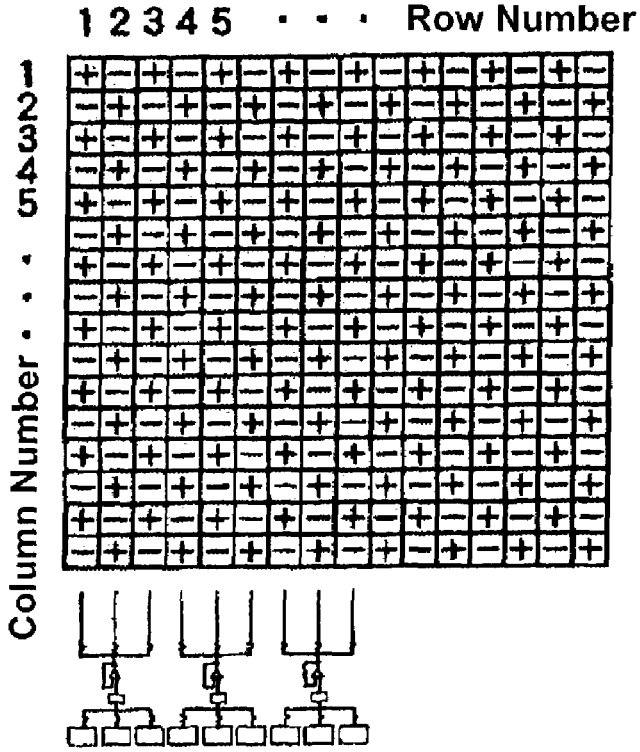
FIGS. 6(*a*) and 6(*b*) are drawings for describing dot scanning methods employed in a liquid crystal driver circuit in accordance with other embodiments of the present invention.
Figure 6:
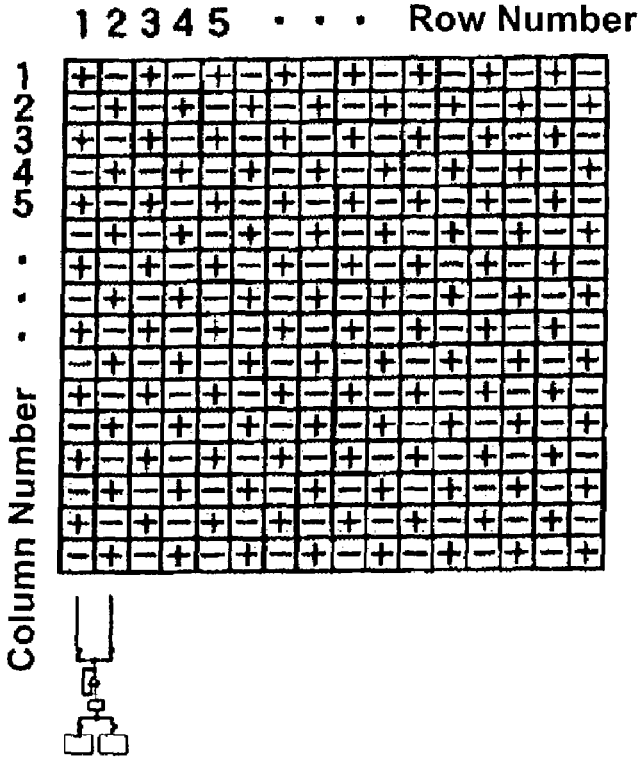
Figure 7:
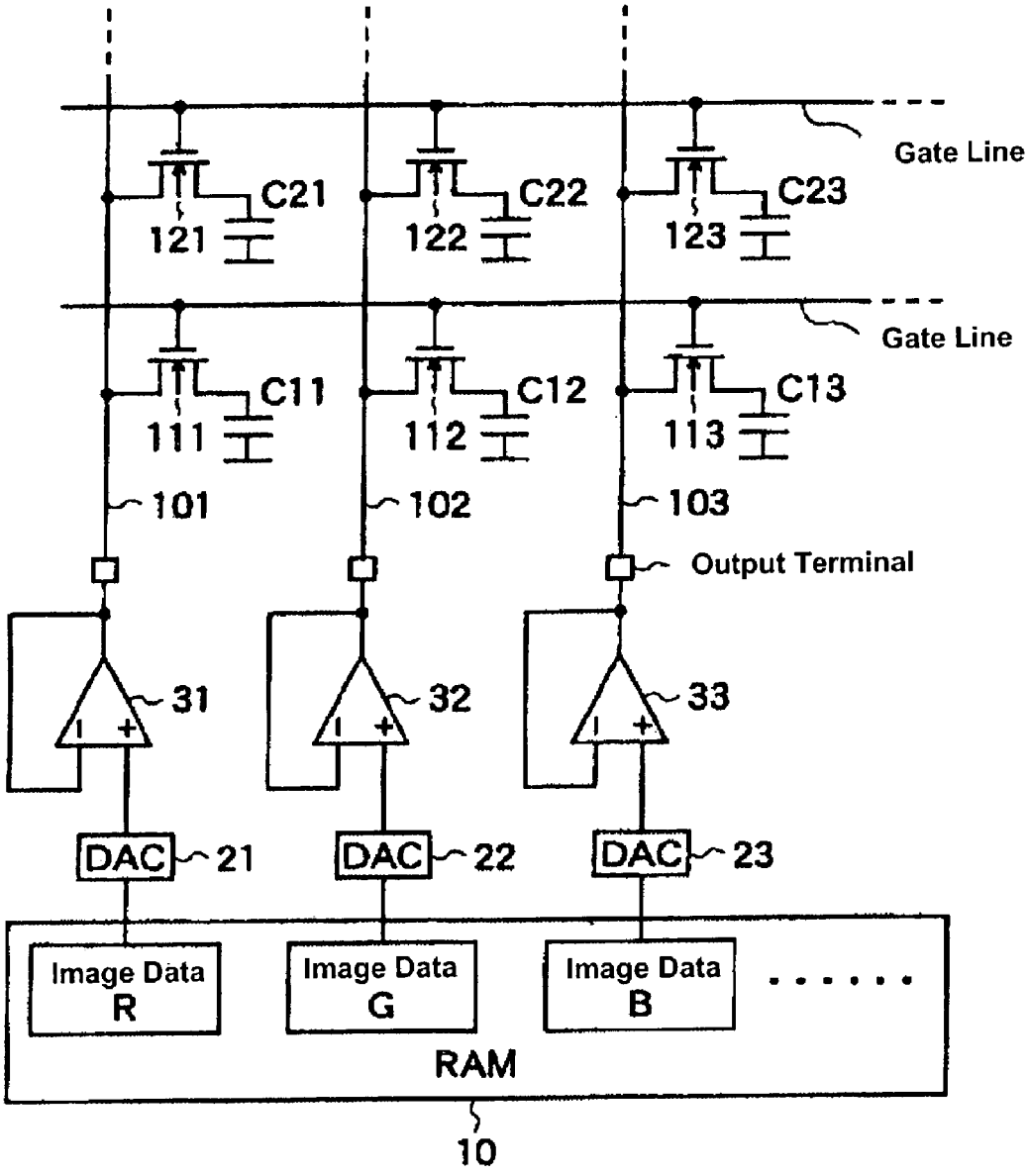
Fig. 7 (Prior Art)
FIG. 7 shows a part of a conventional liquid crystal driver circuit and a part of a liquid crystal display apparatus.

FIGS. 6(*a*) and 6(*b*) are drawings to describe dot scanning methods for the liquid crystal driver circuit in accordance with the present embodiment. In FIGS. 6(*a*) and (*b*), positions of the dots are represented by coordinates (row numbers and column numbers).

FIG. 6(*a*) indicates a dot scanning employed when three channels are switched. More specifically, image data in three channels are successively selected by the switches 41–43 (first selection circuit) indicated in FIG. 2, DA converted and amplified, which are then successively output to three source lines of the TFTs of the liquid crystal display apparatus by the switches 51–53 (collectively referred to as the "second selection circuit").

The switching timing of the transmission gates 33 and 34 (third selection circuit) indicated in FIG. 3 is controlled by the control circuit 60 (FIG. 2) to synchronize with the switching timing of the first and second selection circuits. As a result, the N type operational amplifier 31 and the P type operational amplifier 32 indicated in FIG. 3 can be alternately selected at each horizontal synchronizing period. By setting the order of scanning the corresponding dots as (1, 1)→(2, 1)→(3, 1)→(1, 2)→(2, 2)→(3, 2)→(1, 3)→(2, 3)→(3, 3), the dot inversion indicated in FIG. 6(*a*) is realized.

FIG. 6(*b*) indicates a dot scanning employed when two channels are switched. In this case, image data in two channels are successively selected by the switches 41 and 42 indicated in FIG. 2, DA converted and amplified, which are then successively output to two source lines of the TFTs of the liquid crystal display apparatus by the switches 51 and 52.

The switching timing of the transmission gates 33 and 34 indicated in FIG. 3 is controlled by the control circuit 60 (FIG. 2) to synchronize with the switching timing of the first and second selection circuits. As a result, the N type operational amplifier 31 and the P type operational amplifier 32 indicated in FIG. 3 are alternately selected at each horizontal synchronizing period. By setting the order of scanning the corresponding dots as (1, 1)→(2, 1)→(2, 2)→(1, 2)→(1, 3)→(2, 3)→(2, 4)→(1, 4)→(1, 5), the dot inversion indicated in FIG. 6(*b*) is realized.

In other words, by conducting the dot scanning described above, dots corresponding to TFTs to which output signals of the N type operational amplifier 31 are distributed and dots having TFTs to which output signals of the P type operational amplifier 32 are distributed are mutually arranged adjacent to one another in two directions that are perpendicular to each other.

To provide liquid crystal driver circuits that reduce the power consumption and chip areas by reducing the number of DACs and operational amplifiers without adding an extra latch circuit, aspects of the present invention, can reduce the number of DACs and operational amplifiers without adding an extra latch circuit. Accordingly, the power consumption of liquid crystal driver circuits and chip areas can be reduced. Furthermore, the cost for liquid crystal driver circuits can be reduced.

While aspects of the present invention have been described in terms of certain preferred embodiments, those of ordinary skill in the will appreciate that certain variations, extensions and modifications may be made without varying from the basic teachings of the present invention. As such, aspects of the present invention are not to be limited to the specific preferred embodiments described herein. Rather, the scope of the present invention is to be determined from the claims, which follow.

What is claimed is:

1. A liquid crystal driver circuit comprising:

a memory circuit that temporarily stores inputted image data;

a first selector circuit that successively selects image data that are read from the memonry circuit and outputs the image data;

a digital/analog conversion circuit that converts the image data output from the first selector circuit into analog image signals;

an amplification circuit that amplifies the analog image signals obtained by the digital/analog conversion circuit; and a second selector circuit that successively selects a plurality of output terminals and distributes the analog image signals amplified by the amplification circuit to the plurality of output terminals, wherein the amplification circuit comprises:

a P type amplifier including a P-channel transistor that flows current from a first power supply potential to an output point according to analog image signals obtained by the digital/analog conversion circuit;

an N type amplifier including an N-channel transistor that flows current from an output point to a second power supply potential according to analog image signals obtained by the digital/analog conversion circuit; and a third selector circuit that alternately switches between the analog image signals output from the output point of the P type amplifier and the analog image signals output from the output point of the N type amplifier, and wherein the second and third selector circuits alternately select the analog image signals output from the output point of the P type amplifier and the analog image signals output from the output point of the N type amplifier, and distribute the same in a time-divided manner to a plurality ofT thin film transistors of a liquid crystal display apparatus.

2. A liquid crystal driver circuit according to claim 1, wherein dots having the thin film transistors to which the analog image signals output from the output point of the P type amplifier are distributed and dots having the thin film transistors to which the analog image signals output from the output point of the N type amplifier are distributed are arranged mutually adjacent to one another in two directions perpendicular to each other.

3. A liquid crystal dxiver circuit according to claim 1, wherein the digital/analog conversion circuit is a resistance circuit network type digital/analog converter that converts the image data output in a time-divided manner from the first selector circuit into analog image signals with γ correction being rendered.

4. A liquid crystal driver circuit according to claim 1, and further comprising a control circuit that controls the first through third selector circuits such that selection timings of the first through third selector circuits are synchronized with one another.

5. An electronic apparatus including a liquid crystal driver circuit comprising:

a memory circuit that temporarily stores inputted image data;

a first selector circuit that successively selects image data that are read from the memory circuit and outputs the image data;

a digital/analog conversion circuit that converts the image data output from the first selector circuit into analog image signals;

an amplification circuit that amplifies the analog image signals obtained by the digital/analog conversion circuit; and a second selector circuit that successively selects a plurality of output terminal and distributes the analog image signals amplified by the amplification circuit to the plurality of output terminals, wherein the amplification circuit comprises:

a P type amplifier including a P-channel transistor that flows current from a first power supply potential to an output point according to analog image signals obtained by the digital/analog conversion circuit;

an N type amplifier including an N-channel transistor that flows current from an output point to a second power supply potential according to analog image signals obtained by the digital/analog conversion circuit; and a third selector circuit that alternately switches between the analog image signals output from the output point of the P type amplifier and the analog image signals output from the output point of the N type amplifier, and wherein the second and third selector circuits alternately select the analog image signals output from the output point of the P type amplifier and the analog image signals output from the output point of the N type amplifier, and distribute the same in a time-divided manner to a plurality of thin film transistors of a liquid crystal display apparatus.

6. An electronic apparatus including a liquid crystal driver circuit according to claim 5, wherein dots having the thin film transistors to which the analog image signals output from the output point of the P type amplifier are distributed and dots having the thin film transistors to which the analog image signals output from the output point of the N type amplifier are distributed are arranged mutually adjacent to one another in two directions perpendicular to each other.

7. An electronic apparatus including a liquid crystal driver circuit according to claim 5, wherein the digital/analog conversion circuit is a resistance circuit network type digital/analog converter that converts the image data output in a time-divided manner from the first selector circuit into analog image signals with γ correction being rendered.

8. An electronic apparatus including a liquid crystal driver circuit according to claim 5, and further comprising a control circuit that controls the first through third selector circuits such that selection timings of the first through third selector circuits are synchronized with one another.

9. A liquid crystal driver circuit comprising:

means for temporarily storing inputted image data;

first means for successively selecting image data that are read from the means as for temporarily storing inputted image data and outputting the image data;

means for converting the image data output from the first means for successively selecting image data into analog image signals;

means for amplifying the analog image signals obtained by the means for converting; and second means for successively selecting a plurality of output terminals and disturbing the analog image signals amplified, by the means for amplifying to the plurality of output terminals, wherein the means for amplifying comprises:

a P type amplifier including a P-channel transistor that flows current from a first power supply potential to an output point according to analog image signals obtained by the means for converting;

an N type amplifier including an N-channel transistor that flows current from an output point to a second power supply potential according to analog image signals obtained by the means for converting; and means for alternately switching between the analog image signals output from the output point of the P type amplifier and the analog image signals output from the output point of the N type amplifier, and wherein the second means for successively selecting a plurality of output terminals and the means for alternately switching alternately select the analog image signals output from the output point of the P type amplifier and the analog image signals output from the output point of the N type amplifier, and distribute the same in a time-divided manner to a plurality of thin film transistors of a liquid crystal display apparatus.

10. A liquid crystal driver circuit according to claim 9, wherein dots having the thin film transistors to which the analog image signals output from the output point of the P type amplifier are distributed and dots having the thin film transistors to which the analog image signals output from the output point of the N type amplifier are distributed are arranged mutually adjacent to one another in two directions perpendicular to each other.

11. A liquid crystal driver circuit according to claim 9, wherein the means for converting is a resistance circuit network type digital/analog converter that converts the image data output in a time-divided manner from the first means for successively selecting image data into analog image signals with γ correction being rendered.

12. A liquid crystal driver circuit according to claim 9, and further comprising means for controlling that controls the first means for successively selecting, the second means for successively selecting, and the means for alternately switching such that selection timings of the first means for successively selecting, the second means for successively selecting, and the means for alternately switching are synchronized with one another.

* * * * *